US011639596B2

(12) United States Patent
Wang et al.

(10) Patent No.: US 11,639,596 B2
(45) Date of Patent: May 2, 2023

(54) BATHTUB FAUCET

(71) Applicant: Xiamen Lota International Co., LTD, Fujian (CN)

(72) Inventors: Lucheng Wang, Xiamen (CN); Jianping Zhou, Xiamen (CN); Liming Ye, Xiamen (CN); Chuanbao Zhu, Xiamen (CN)

(73) Assignee: XIAMEN LOTA INTERNATIONAL CO., LTD., Xiamen (CN)

( * ) Notice: Subject to any disclaimer, the term of this patent is extended or adjusted under 35 U.S.C. 154(b) by 330 days.

(21) Appl. No.: 16/893,456

(22) Filed: Jun. 5, 2020

(65) Prior Publication Data

US 2021/0010250 A1 Jan. 14, 2021

(30) Foreign Application Priority Data

Jun. 5, 2019 (CN) ..... 201910485920.X

(51) Int. Cl.
*E03C 1/04* (2006.01)
*B05B 15/62* (2018.01)
*B05B 12/14* (2006.01)

(52) U.S. Cl.
CPC ..... *E03C 1/0404* (2013.01); *B05B 12/1418* (2013.01); *B05B 15/62* (2018.02)

(58) Field of Classification Search
CPC ..... E03C 1/0404; E03C 1/04; E03C 1/023; E03C 2201/30; B05B 12/1418; B05B 15/62; B05B 12/002; B05B 1/1609; B05B 12/04
See application file for complete search history.

(56) References Cited

U.S. PATENT DOCUMENTS 4,095,610 A * 6/1978 Priesmeyer ..... F16K 11/0746 137/119.03
10,718,103 B2 * 7/2020 Johnson ..... F16K 11/0445

FOREIGN PATENT DOCUMENTS

DE WO 2020165002 A1 * 2/2019

OTHER PUBLICATIONS

English translation of WO2020/165002 A1 (Year: 2019).*

* cited by examiner

*Primary Examiner* — Qingzhang Zhou
(74) *Attorney, Agent, or Firm* — Foley & Lardner LLP

(57) ABSTRACT

The present invention relates to the technical field of fluid switches, and more particularly to an bathtub faucet, comprising a housing (10), a first valve (11) which is disposed in the housing in the radial direction of the housing (10) and configured for switching on or switching off the flow of the fluid towards the outlet (100); a first base (12) which is disposed in the housing in the axial direction of the housing (10) and configured for diverting the fluid therethrough, and the first base comprises: first fluid guiding ports (120) disposed along the radial direction of the first base (12) and second fluid guiding ports (121) disposed at two ends of the first base (12) along its axial direction and are respectively communicated with the first fluid guiding port (120), and the first valve (11) is configured to sealingly engage to the first base (12) and communicated with the first fluid guiding ports (120), so that the fluid is controlled by the first valve (11) to be communicated with the second fluid guiding port (121) at the upper end or shut off, wherein the fluid is introduced from the second fluid guiding port (121) at the lower end and then diverted through the first fluid guiding port (120).

8 Claims, 17 Drawing Sheets

A-A

B-B

A-A

B-B

A-A

B-B

A-A

BATHTUB FAUCET

TECHNICAL FIELD

The present invention relates to the technical field of fluid switch, and in particular, to a bathtub faucet.

BACKGROUND

Bathtub faucet is mainly used for filling the bathtub with water or supporting a shower head so as to implement a shower operation. Green brass material is popular in the existing bathtub faucet for delivering the fluid. For example, a Chinese Patent CN102072336A discloses a bathtub faucet, which comprises a faucet switch, a mixing transverse pipe, a hot water inlet, a cold water inlet, a bathtub water outlet and a nozzle water outlet. The faucet switch is connected in the center of the mixing transverse pipe. The hot water inlet and the cold water inlet are connected at two ends of the one side of the mixing transverse pipe, while the other side of the mixing transverse pipe is provided with water outlet pipe. The bathtub water outlet is disposed at the front end of the water outlet pipe and the nozzle water outlet is disposed at the rear end of the water outlet pipe. The nozzle water outlet is connected to a shower head via a hose. In this bathtub faucet, the fluid is flown through various metal pipes directly.

The tube of the green brass utilized in the above-mentioned bathtub faucet is generally manufactured by a complicated process and mould, which significantly increases the manufacturing cost of the tube of the green brass. For example, a mould used for molding the metallic material needs to meet some requirements, comprising the precision of opening/closing the mould, the cooperation between a set of moulds, and the prevention of mold mark and friction mark, and so on. The tube of the green brass is mainly manufactured by sand casting process and the resulted casting has many defects, such as, easily changed size, more complicated process procedures, high manufacture cost, high reject ratio and many post treatment procedures.

In view of this, it is necessary to design an improved bathtub faucet so as to overcome these defects in the existing technology.

SUMMARY OF THE INVENTION

Therefore, it is an object of the present invention to provide a bathtub faucet, thereby overcoming the disadvantages of the existing technology.

To implement above object, this invention provides a bathtub faucet, comprising: a housing; a first valve, which is disposed in the housing in the radial direction of the housing and configured for switching on or switching off the flow of the fluid towards the outlet; a first base, which is disposed in the housing in the axial direction of the housing and configured for diverting the fluid therethrough, and the first base comprises: first fluid guiding ports, which are disposed along the radial direction of the first base; second fluid guiding ports, which are disposed at two ends of the first base along its axial direction and are respectively communicated with the first fluid guiding port, and the first valve is configured to sealingly engage to the first base and communicated with the first fluid guiding ports, so that the fluid is controlled by the first valve to be communicated with the second fluid guiding port at the upper end or shut off, wherein the fluid is introduced from the second fluid guiding port at the lower end and then diverted through the first fluid guiding port.

In a preferred embodiment, the housing comprises at least two outlet end; the bathtub faucet further comprises: a second valve, which is configured for switching the flowing path so as to discharge the fluid introduced by the first valve through one of the outlet ends; a second base, which is disposed in the housing along the axial direction of the housing and engaged to the first base, and the second base is communicated with the second fluid guiding port at the upper end of the first base; the second valve is disposed along the radial direction of the second base and partially engaged therein.

In a preferred embodiment, the first base is configured as a columnar member with a lateral recess portion, and the first valve can seat in the lateral recess portion and sealingly engage to water inlets and a water outlet of the first fluid guiding port.

In a preferred embodiment, the water outlet is configured into a ring shape and communicated with the second fluid guiding port at the upper end of the first base.

In a preferred embodiment, the lateral recess portion further has a positioning portion which is engaged to the first valve so as to delimit the first valve in the lateral recess portion.

In a preferred embodiment, the first base is provided with an anti-rotation portion adjacent to its lower end in the radial direction, and the circumference surface of the housing is provided with an anti-rotation engagement, wherein the anti-rotation portion is matched with the anti-rotation engagement so as to prevent the undesired rotation of the first base relative to the housing.

In a preferred embodiment, the second base is seated on the first base and engaged to the first base.

In a preferred embodiment, the housing further comprises an arm radially disposed thereon, and one of the outlet end is disposed on the upper end of the housing in the axial direction, and the other outlet end is disposed on the arm; the bathtub faucet also comprises the third base, which is disposed in the arm and configured for diverting the fluid flowing therein; and a connector, which is engaged to the third base by passing through the outlet end on the arm and communicated with the third base.

In a preferred embodiment, a support portion is configured within the second base for engaging the second valve, the support portion is formed by the inner wall extending radially inwardly from the second base, and then an third fluid guiding port is formed on the end extending from the inner wall; the second valve is received in the support portion and has two switching configuration; at the first configuration, the second valve is pressed to block the third fluid guiding port so that the fluid coming from the second fluid guiding port at the upper end of the first base is switched off and guided to the third base; at the second configuration, the second valve is pressed to open the third fluid guiding port so that the fluid coming from the second fluid guiding port at the upper end of the first base is delivered to the outlet end at the upper end of the housing.

In a preferred embodiment, the arm is disposed with a gripping portion at its end away from the housing, and the gripping portion is configured for supporting a shower head, a fluid introduction end of which is connected to the connector.

A part of other features and advantages of the present invention will be apparent to the skilled person in the art after reading the disclosure, while the other part will be described in the following specific embodiment in combination with the drawings.

BRIEF DESCRIPTION OF DRAWINGS

Hereinafter, the embodiments of the present invention will be described in detail in combination with drawings, wherein.

DETAILED DESCRIPTION

Figure 1:
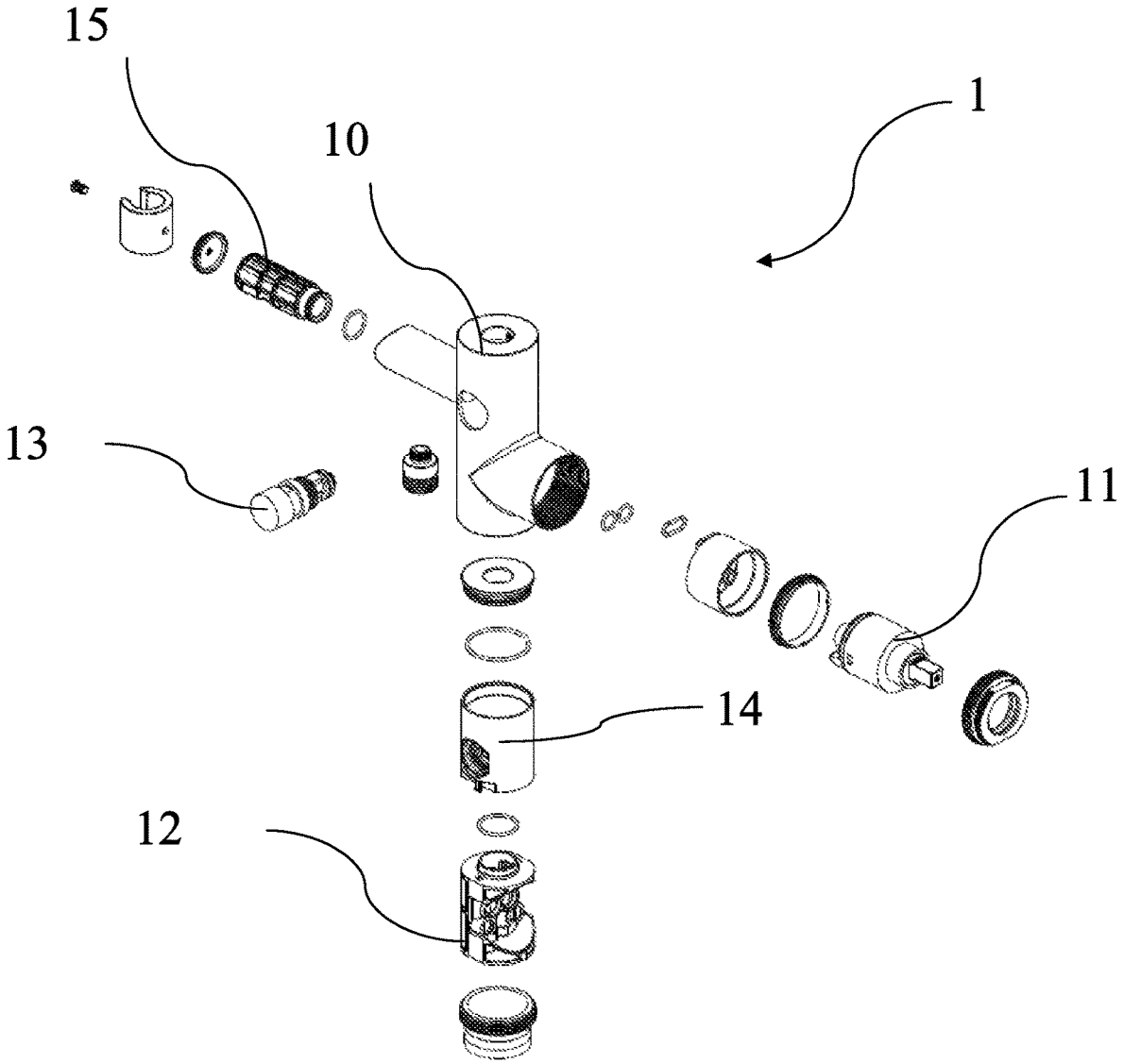
FIG. 1 is a partially exploded view of the bathtub faucet.

Now the schematic solutions of the extraction faucet disclosed by the present invention will be described in detail. Although some drawings are provided to illustrate some embodiments of the present invention, these drawings may not necessarily be depicted in scale, and some features may be enlarged, removed or cut off in part to show and explain the disclosure of the present invention better. The positions of some elements in the drawings may be adjusted as desired without influencing the technical effect. The phrase "in the drawings" or the like presented in the description may not refer to all the drawings or examples.

Some orientation terms, e.g. "inner", "outer", "upper", "lower" and other orientation terms, as used hereinafter for describe the drawings will be understood as having their normal meanings and indicating those directions as involved when the drawings are viewed normally. Basically, the orientation terms as stated in the present specification will be interpreted according to the routine directions as understood by the skilled person in the art, unless otherwise specified.

The terms "first", "the first", "second", "the second" and the like as used in the disclosure do not represent any order, amount or importance in this invention, but rather are used to differentiate one element from other elements.

Figure 2:
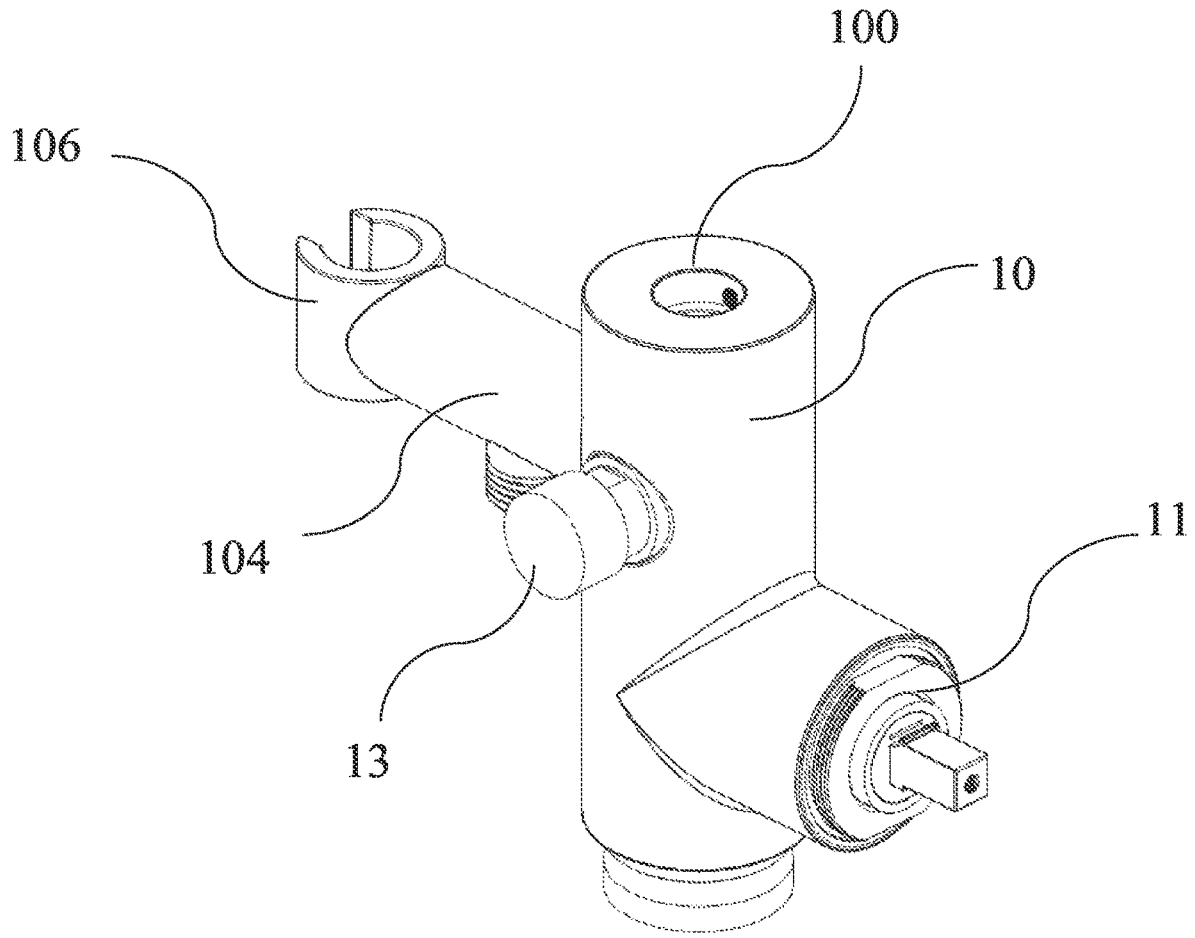
FIG. 2 is an assembled view of the bathtub faucet as shown in FIG. 1.
Figure 3:
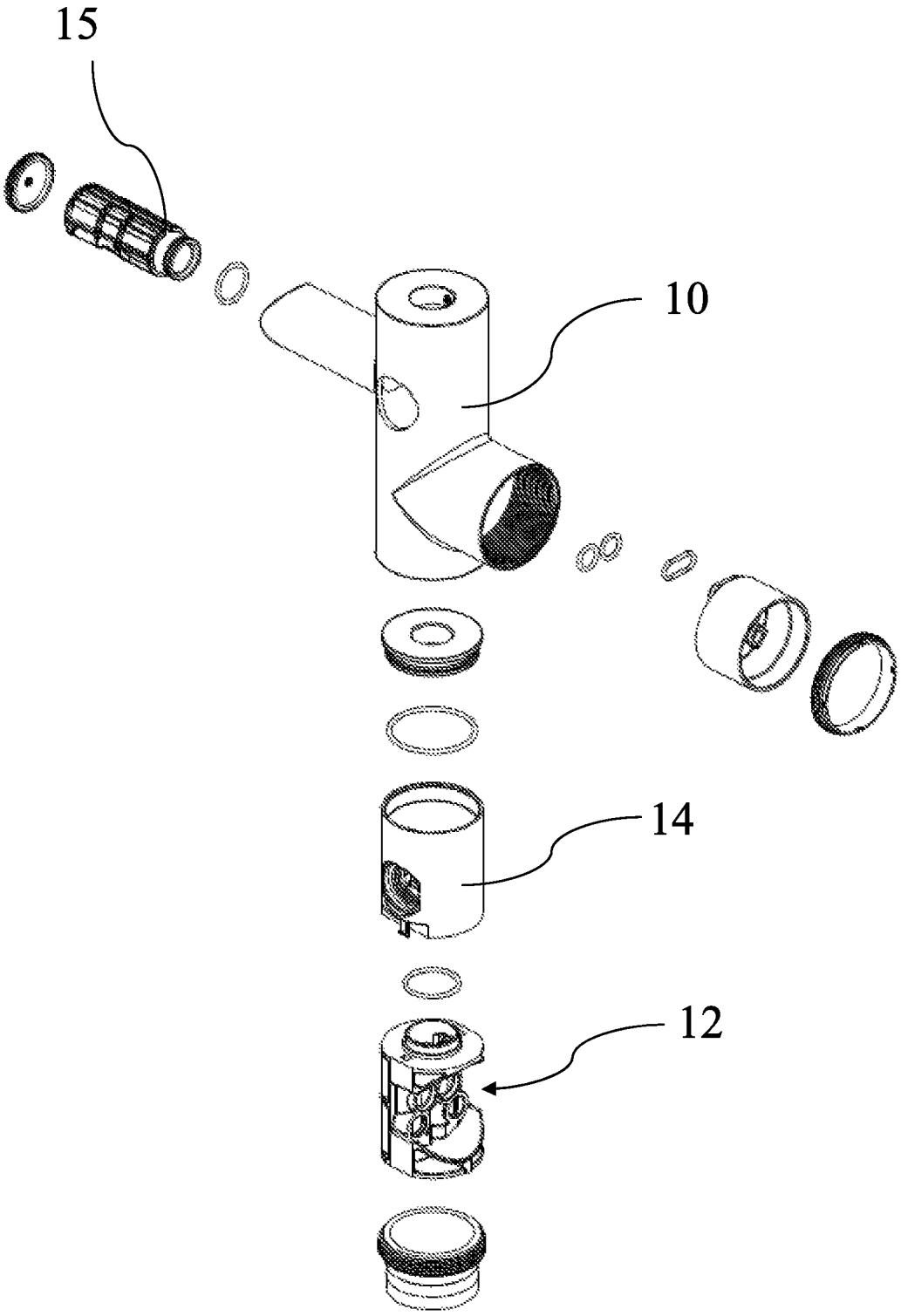
FIG. 3 is a partially exploded view of the FIG. 1 without showing the mixing valve and the switching valve.

As shown in FIGS. 1 to 21, the invention provides a bathtub faucet 1, in particular as shown in FIGS. 1 to 3, which comprises a housing 10, a mixing valve 11 (which is also referred to as a first valve 11), a switching valve component and a fluid diverted base 12 (which is also referred to as a first base 12), wherein the switching valve component comprises a switching valve 13 (which is also referred to as a second valve 13) and a switching valve base 14 (which is also referred to as a second base 14). It is certain that the switching valve 13 and the switching valve base 14 can be dependently presented, sold and used in other types (i.e. not in a combined type), according to the different applications and the demands of the related personal. The switching valve base 14 and the fluid diverted base 12 can be mounted in the housing 10 and disposed in sequence from top to bottom in the axial direction of the housing 10. The mixing valve 11 is mainly used for permitting or shutting off the fluid flowing towards a fluid outlet end (e.g., a water nozzle of the faucet or the shower head) and mixing the cold and hot fluid flowing through the mixing valve so as to obtain the desired mixing water with suitable temperature which meets the demands of users. The switching valve 13 is mainly used for switching over the fluid to the water nozzle or shower head of the water faucet as requested by the users. The fluid diverted base 12 in use is mainly used for switching over the fluid flowing therein so that the fluid can be controlled by the mixing valve 11 for being discharged or shut off.

The bathtub faucet 1 provided in this invention will be described in detail hereinafter.

Figure 10:
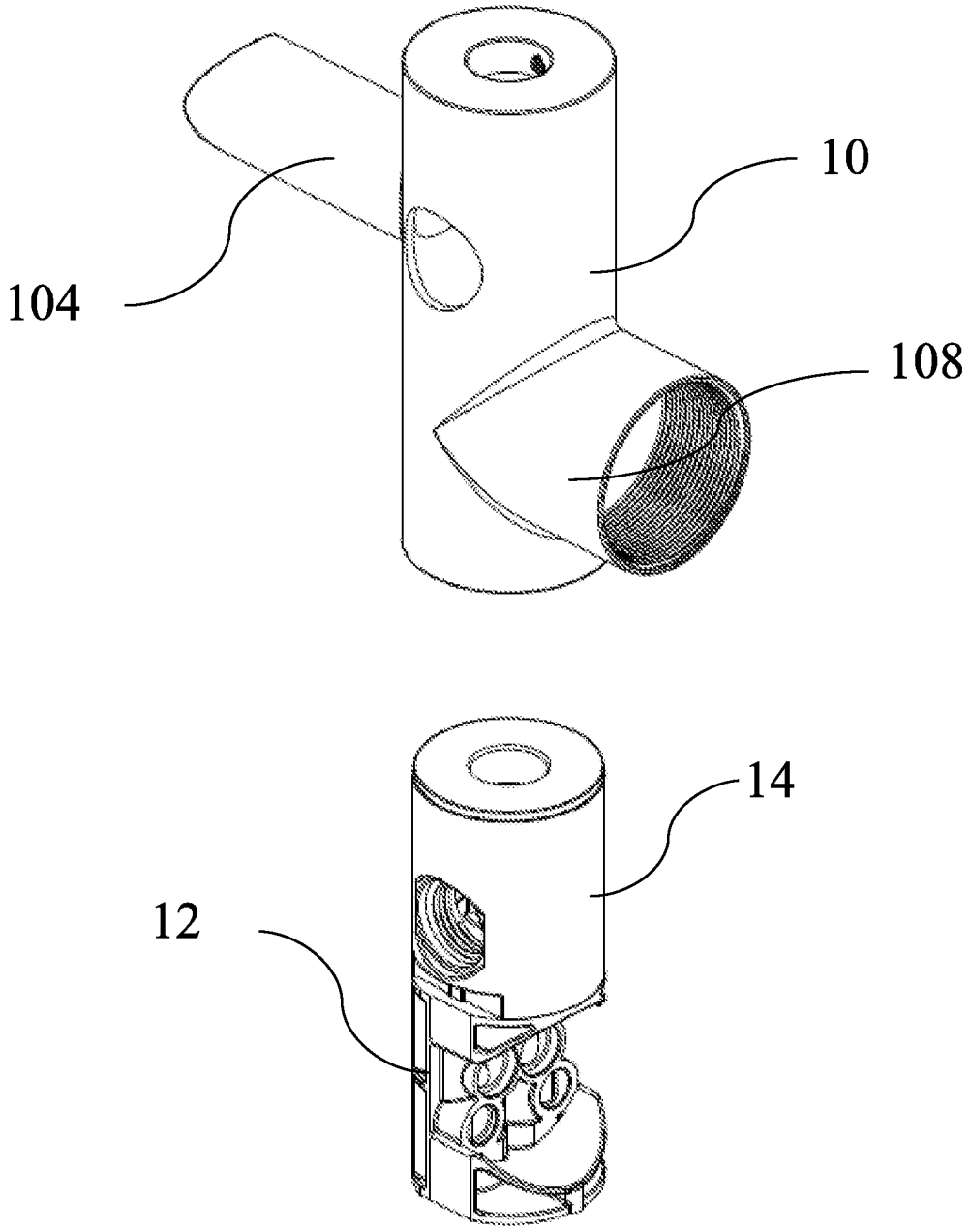
FIG. 10 is another partially enlarged and exploded view of the bathtub faucet as shown in FIG. 1.
Figure 27:
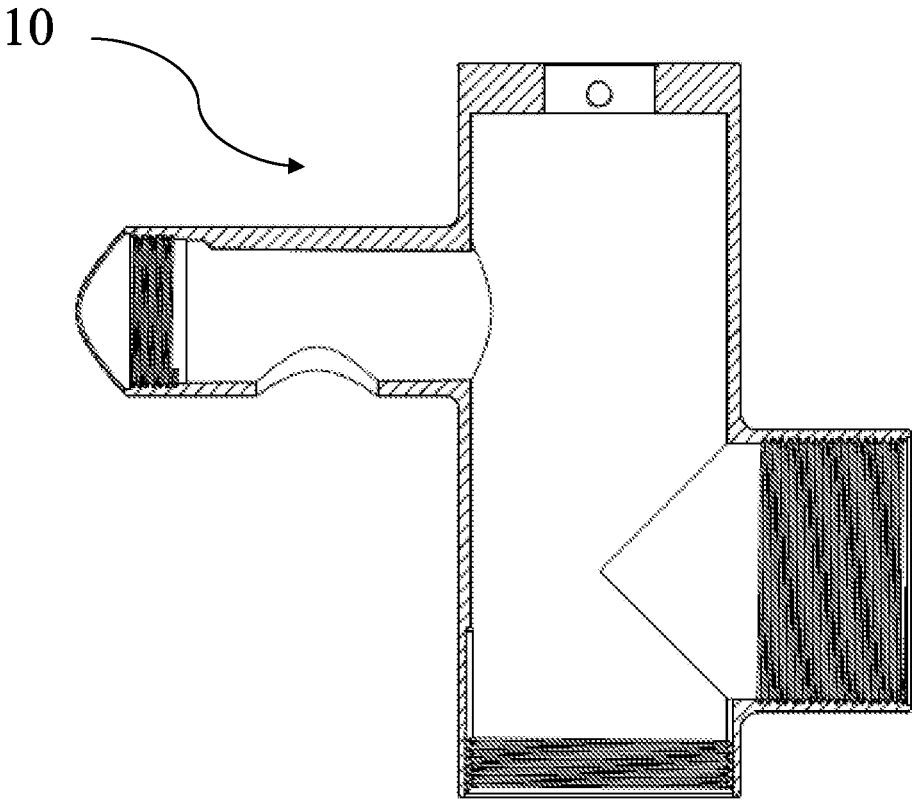
FIG. 27 is a sectional view of the housing.

The housing 10 is columnar and has a receiving portion 108 (as shown in FIG. 10 and FIG. 27) disposed on its radial direction. The mixing valve 11 is disposed in the receiving portion 108, and the housing 10 is also provided with a receiving hole, though which the switching valve 13 is mounted onto the switching valve base 14. When the housing 10 is disposed vertically, the fluid is introduced from the inlet end provided on the lower end of the housing 10. The inlet end is generally used for the fluid directing tube (which can be one for directing cold water or hot water) passing through therein, and then the fluid is delivered to the mixing valve 11 after flowing through the fluid diverted base 12. Under the situation of the mixing valve 11 being switched on, the fluid would be continuously directed to the outlet end disposed on the upper of the housing 10, if the switching valve 13 has not been operated.

Referring to FIGS. 12 to 15, the fluid diverted base 12 is generally configured into cylindrical shape and provided with a space (the space can be referred to as lateral recess portion 122) for receiving the mixing valve 11, wherein the space is inwardly recessed on the lateral portion of the fluid diverted base 12 and delimited by walls being radially protruded on the lateral portion of the fluid diverted base 12. The delimited wall 124 (which is also referred to as positioning portion 124) is cambered on the upper and lower ends of the fluid diverted base 12 in the vertical direction. Cold/hot fluid openings 1200, a mixture opening and fixing holes 126 can be delimited within the scope delimiting by the delimited wall 124. The delimited wall 124 can be used for positioning the mixing valve 11.

Figure 12:
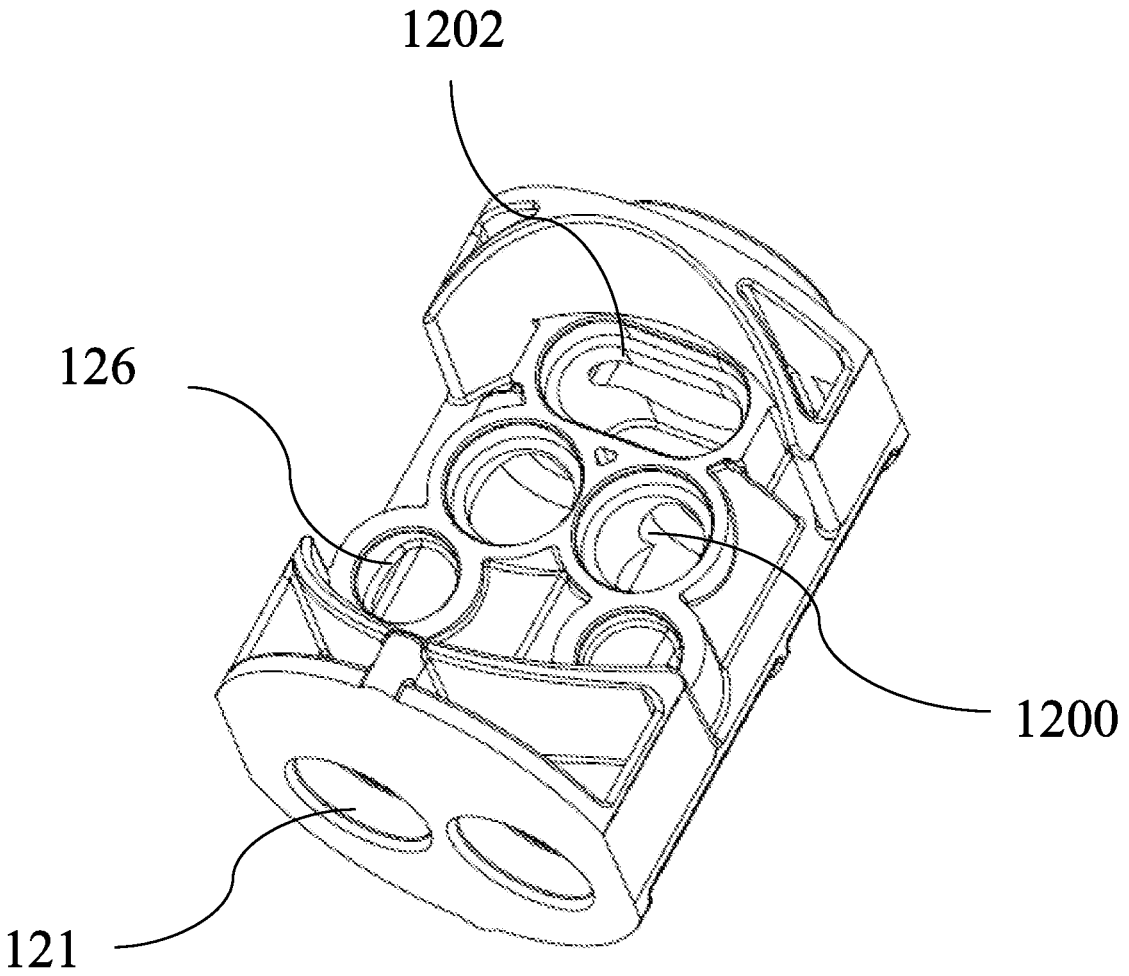
FIG. 12 is a perspective view of the fluid diverted base.
Figure 13:
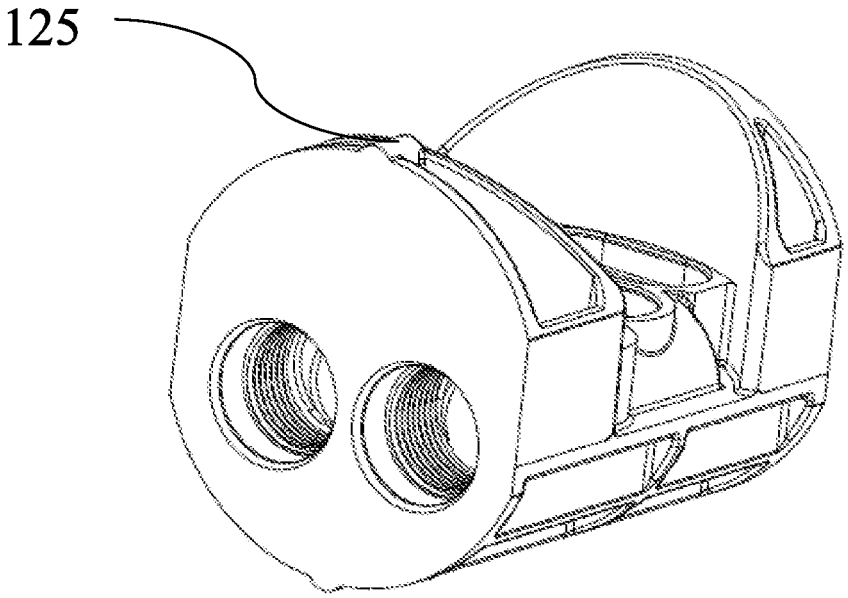
FIG. 13 is bottom perspective view of the fluid diverted base.

When the fluid diverted base 12 is disposed vertically, its inlet is located at lower and its outlet is located at upper. The inlet and the outlet can be referred to as the second fluid guiding port 121. Nevertheless, the fluid is not directly flowed from the inlet to the outlet in the axial direction of the fluid diverted base 12. The fluid diverted base 12 has a meandering fluid directing path. As the fluid diverted base 12 is disposed horizontally as shown in FIG. 12, the fluid directing path is generally presented in the shape of "a". The fluid is introduced through the second fluid guiding port 121 located at the bottom of the fluid diverted base 12, and then diverted through a first fluid guiding port 120 (the first fluid guiding port 120 comprises cold/hot fluid openings 1200 and the mixture opening 1202), and subsequently discharged to the second fluid guiding port 121 on the upper end of the fluid diverted base 12, therefore the path of the fluid within the fluid diverted base 12 can be completed.

The lateral portion (i.e., in the radial direction of the fluid diverted base 12) of fluid diverted base 12 is provided with cold/hot fluid openings (the cold fluid opening and the hot fluid opening can be both referred to as water inlets), mixture opening 1202 (which can be referred to water outlet) and fixing hole 126. In the FIG. 12 as shown in this embodiment, the amount of the cold fluid opening and the hot fluid opening are totally two. However, it is certain that the quantities of the fluid opening can be changed as desired. The two fluid openings are generally used for providing cold water and hot water, respectively. The fixing hole 126 is mainly used for positioning the mixing valve 11 comprising a mixing valve base 112 and a mixing valve spool 110, wherein the mixing valve base 112 is provided with fixing elements 1120 on the side being cooperated with the fluid diverted base 12. The fixing elements 1120 can be pins, through which the mixing valve 112 can be matched with the fixing holes 126 so as to implement the positioning of the mixing valve relative to the fluid diverted base 12.

The mixture opening 1202 is an outlet opening for supplying the mixed water into the fluid diverted base 12 and then discharging the mixed water towards the outlet. The mixture opening 1202 is communicated with the outlet (which is one of the second fluid guiding ports 121) disposed on the top of the fluid diverted base 12 and is annular, in particular oval (which is shaped like the playground, i.e., one combined shape is obtained by two semicircles being connected on the two ends of one rectangle) and disposed on the lateral portion of the fluid diverted base 12 for providing a flow area as large as possible while the processing procedure can be met. It is certain that other shape being suitable for outlet opening can be considered.

Referring to FIGS. 12 to 17, the mixing valve base 112 of the mixing valve 11 is provided with fluid guiding ports and a general arc-shaped discharge opening at the side of the mixing valve base 112 facing towards the fluid diverted base 12, wherein the fluid guiding ports are matched with the cold/hot fluid openings 1200 and the discharge opening is matched with the mixture opening 1202. The fluid guiding ports and the discharge opening both are formed by protruding from the mixing valve base 112 (as shown in FIGS. 18 to 21) towards the fluid diverted base 12 in order to engage to the corresponding cold/hot fluid openings 1200 and the mixture opening 1202 on the fluid diverted base 12. The mixing valve base 112 is sealingly engaged with the fluid diverted base 12 and such sealed engagement is obtained by disposing seals between the mixing valve base 112 and the fluid diverted base 12, in particular some seals (sealing ring) disposed around every opening for the fluid flowing through therein, and such seal is provided for only preventing the fluid overflowing outwards from first fluid guiding ports 120 without affecting the delivery of the fluid.

The mixing valve spool 110 is seated in the mixing valve base 112 by inserting through the receiving portion 108 laterally disposed on the housing 10. The ratio of the cold and hot fluid through the mixing valve spool 110 can be adjusted for mixing the cold and hot fluid to a desired temperature based on user's preference. The mixing valve base 112 is inserted into the housing 10 though the receiving portion 108 of the housing 10, and further received in the lateral space of the fluid diverted base 12 and engaged with the fluid diverted base 12, and finally the mixing valve spool 110 is seated in the mixing valve base 112. Such structural design does not only meet functional requirements but also provide a compact entire structure of components for saving more spaces.

Figure 22:
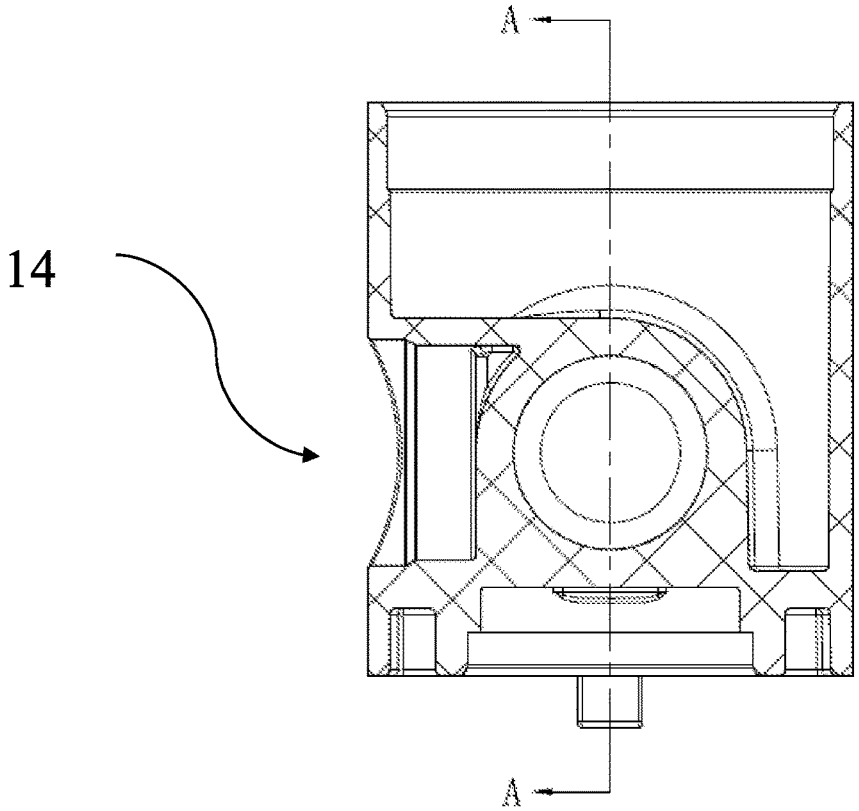
FIG. 22 is a front view of the switching valve base.
Figure 23:
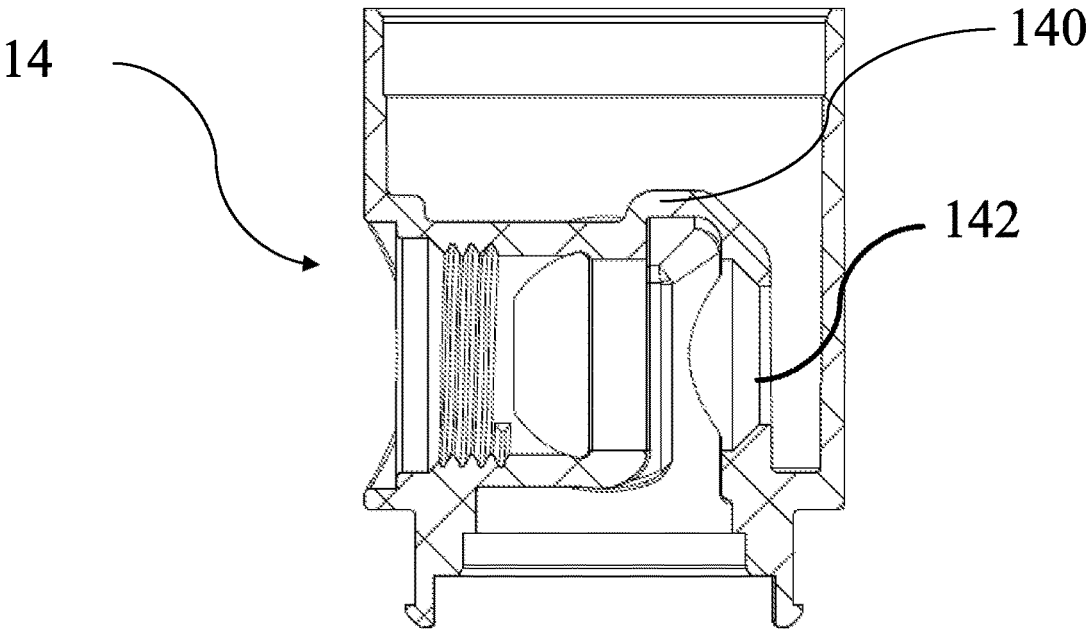
FIG. 23 is a sectional view of FIG. 22 along line A-A.
Figure 24:
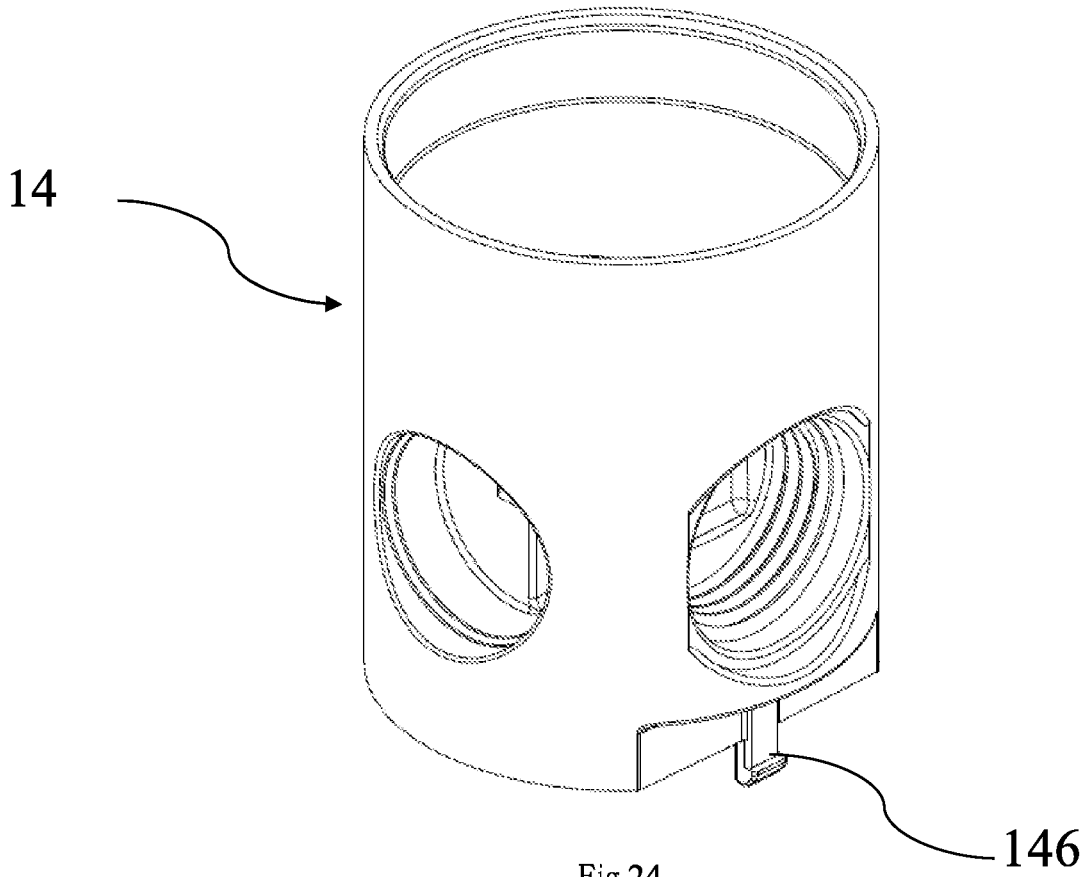
FIG. 24 is a perspective view of the switching valve base.

As shown in FIGS. 22 to 24, the switching valve base 14 is generally tubular, at the lower end of which a corresponding open is provided for connecting with the upper discharge (i.e., the second fluid guiding port 121) of the fluid diverted base 12 and at the upper end of which a cover 144 is provided. At the engagement position of the cover 144 and the switching valve base 14, seal(s) is/are provided so as to prevent the fluid within the switching valve base 14 leaking into the inner cavity of the housing 10. The cover 144 has an opening at its upper end. The opening is aligned with the outlet end of the housing 10 for supplying the mixing water to the water nozzle connected at the outlet end. The switching valve 13 has an opening which is communicated with the inner cavity of the arm 104 (which will be described in detail hereinafter) of the housing 10.

A pair of locking hooks 146 is provided at the side of the switching valve base 14 facing towards the fluid diverted base 12. A pair of locking holes 127 is provided at the side of fluid diverted base 12 facing towards the switching valve base 14. The switching valve base 14 is firmly positioned on the fluid diverted base 12 by means of the engagement of locking hooks 146 and the locking holes 127. The locking hooks 146 of the switching valve base 14 generally extend in the form of hanging arm from its bottom and the extended end is bent to form a hook. It is also conceivable that the engagement between the switching valve base 14 and the fluid diverted base 12 is realized by an interference fit. Furthermore, the embodiments provided in this invention are only used for illustrating the possible engagement type between them, but it is not possible for these embodiments to include all possible engagement type and some engagement types not listing in this invention are also possible and suitable for this invention.

In particular, referring to FIG. 23, the interior of the switching valve base 14 is provided with a support portion 140 in the radial direction and the support portion 140 is formed by the inner wall extending radially inwardly from circumferential wall, and then an aperture is formed on the switching valve 14 in its circumferential direction. The inner wall generally encloses a circular space extending in the radial direction. A third fluid guiding port 142 is provided at the end extended from the inner wall. The receiving hole of the housing 10 is aligned with the aperture of the switching valve base 14.

Figure 25:
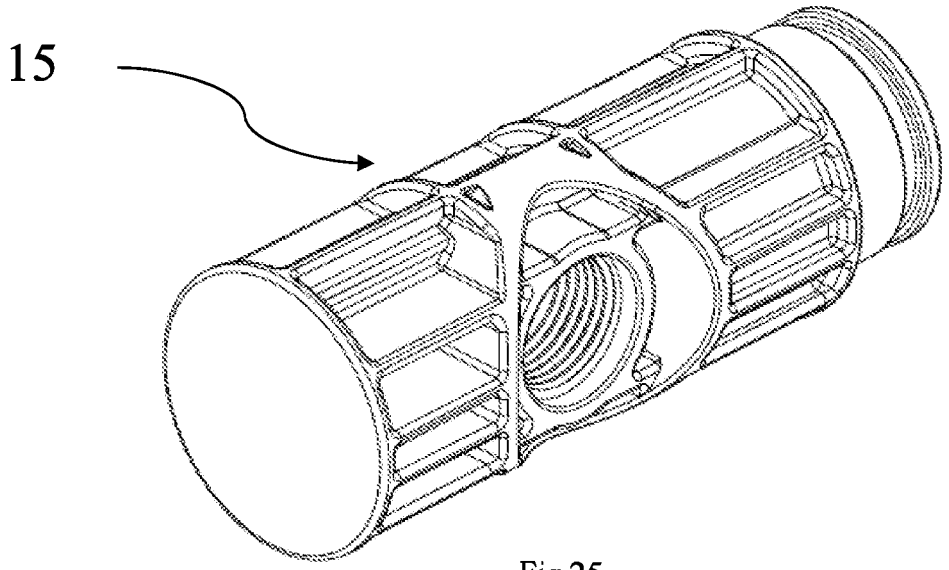
FIG. 25 is a perspective view of the shower adapter base.

The switching valve 13 is inserted into the circular space of the switching valve base 14 after sequentially passing through the receiving hole of the housing 10 and the aperture of the switching valve base 14 and supported by the support portion 140. Meanwhile, the switching valve 13 can situate at two working configurations. When it is necessary for the fluid to be delivered to the shower head, the user can press the switching valve 13, and then a valve stem drives the core located at its end to move towards the third fluid guiding port 142, and finally the core blocks the third fluid guiding port 142, therefore the fluid is delivered to the inner cavity of the arm 104 (which will be described in detail hereinafter) by passing the opening on the switching valve base 14 and finally to shower head after being diverted by a shower adapter base 15 within the inner cavity Las shown in FIG. 25). When it is necessary for the fluid to be switched from the shower head to the water nozzle of the faucet, the user can press the switching valve 13 again, and then the valve stem drive the core located at its end to move away from the third fluid guiding port 142 and stop moving at the time of the third fluid guiding port 142 being opened, therefore the mixing water discharged from the fluid diverted base 12 is delivered to the outlet end of the housing 10 by passing through the third fluid guiding port 142 and further delivered to the water nozzle of the faucet.

Figure 14:
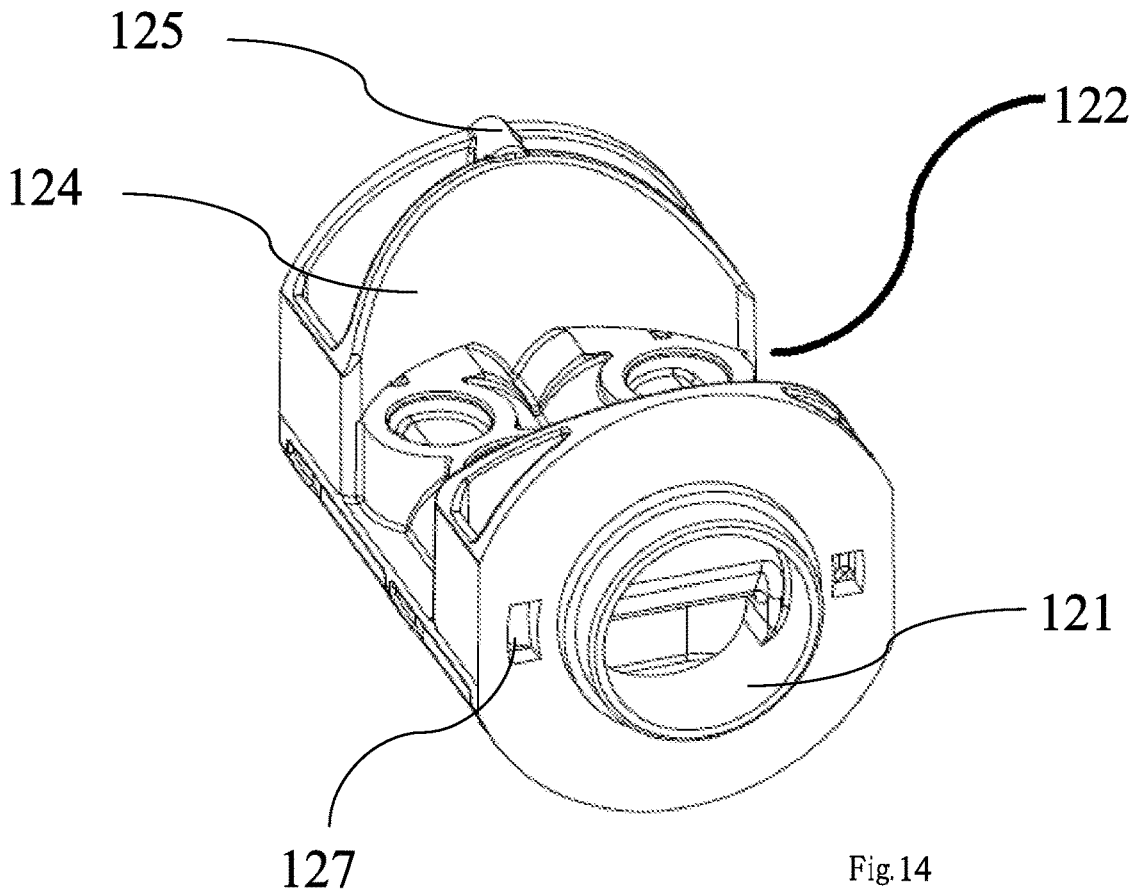
FIG. 14 is top perspective view of the fluid diverted base.
Figure 15:
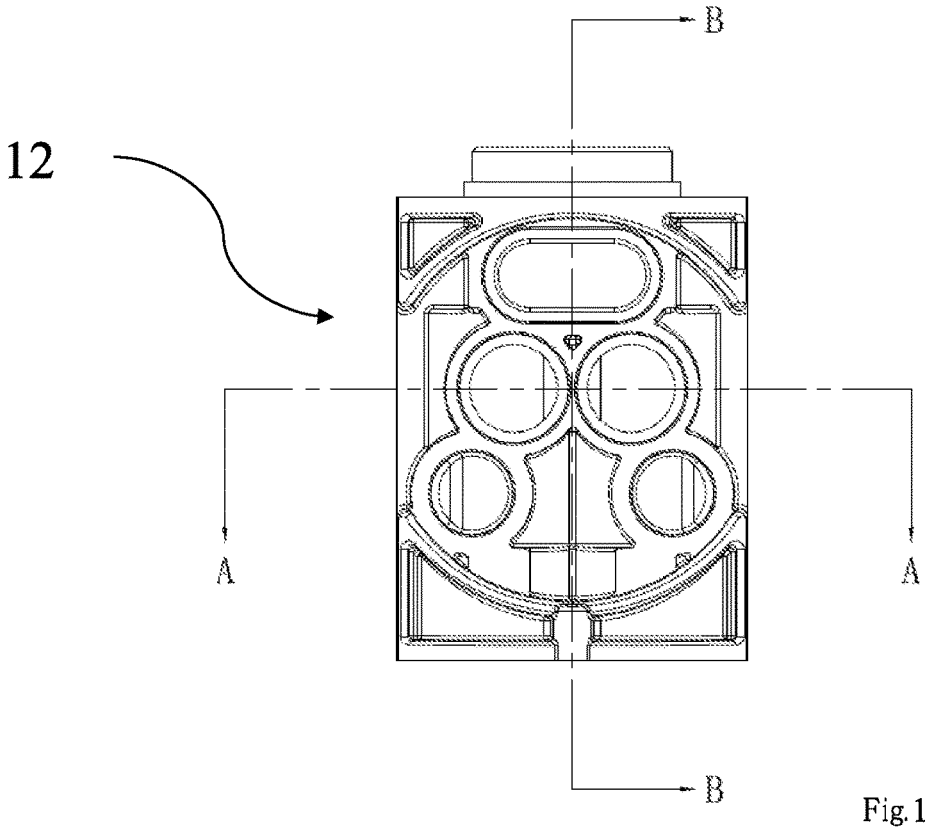
FIG. 15 is front perspective view of the fluid diverted base.
Figure 16:
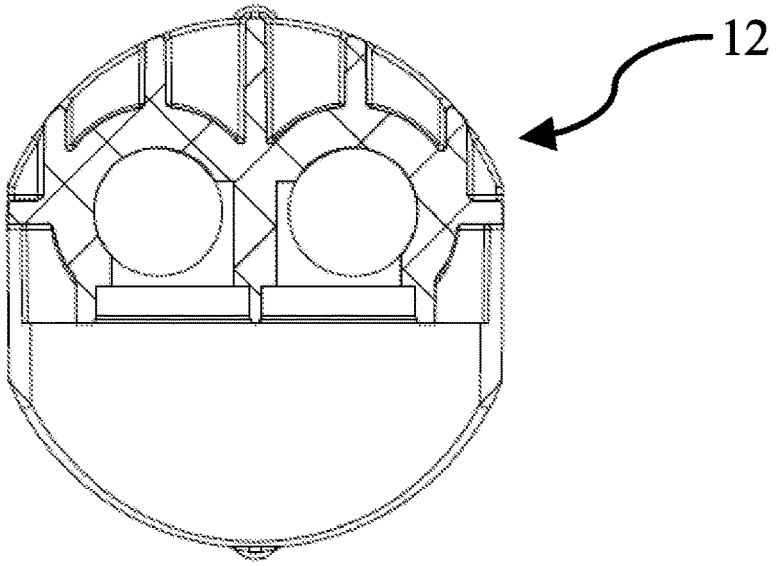
FIG. 16 is a sectional view of the of FIG. 15 along line A-A.
Figure 17:
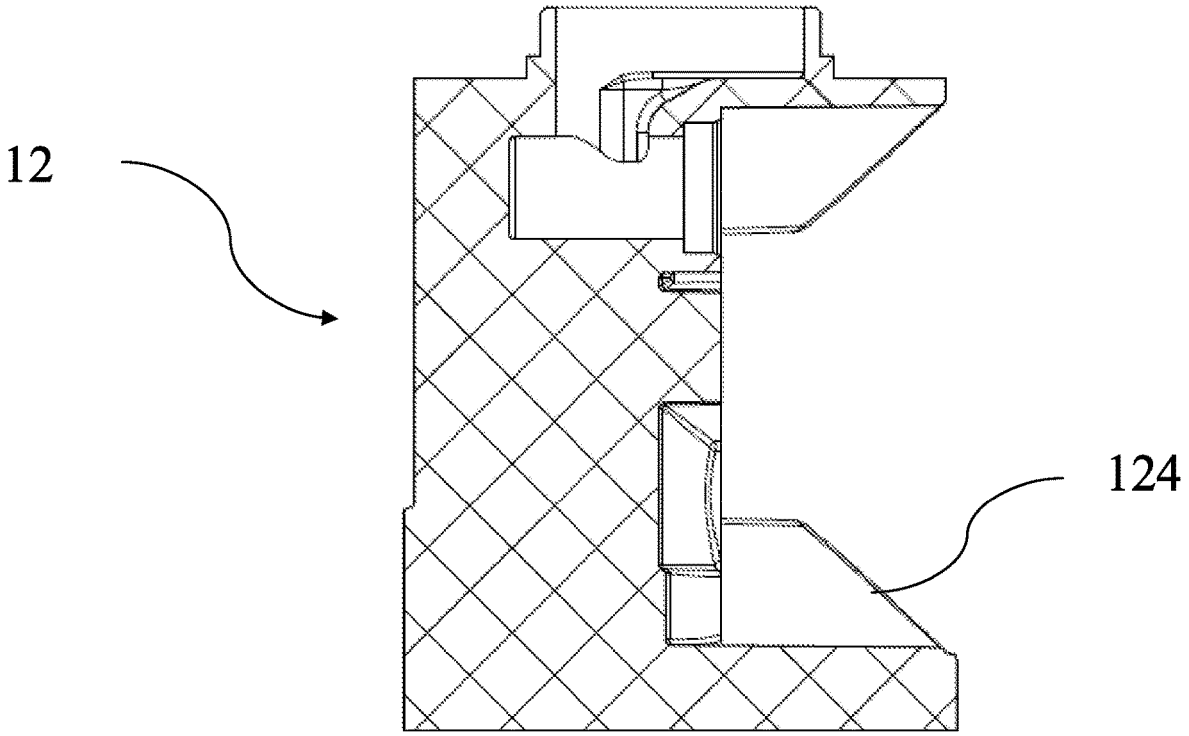
FIG. 17 is a sectional view of the of FIG. 15 along line B-B.
Figure 18:
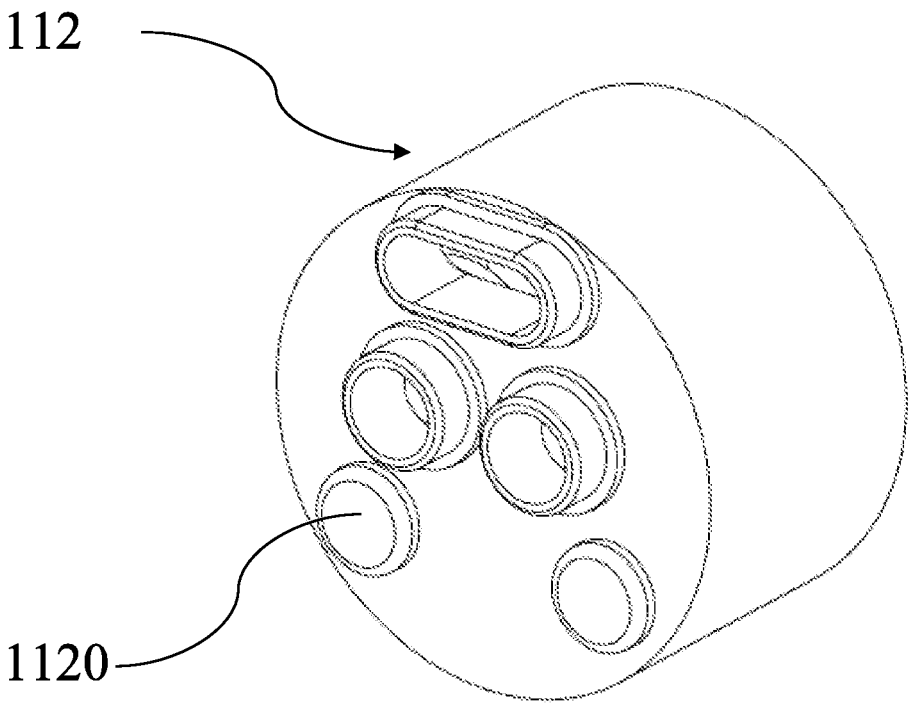
FIG. 18 is a perspective view of the mixing valve base.
Figure 19:
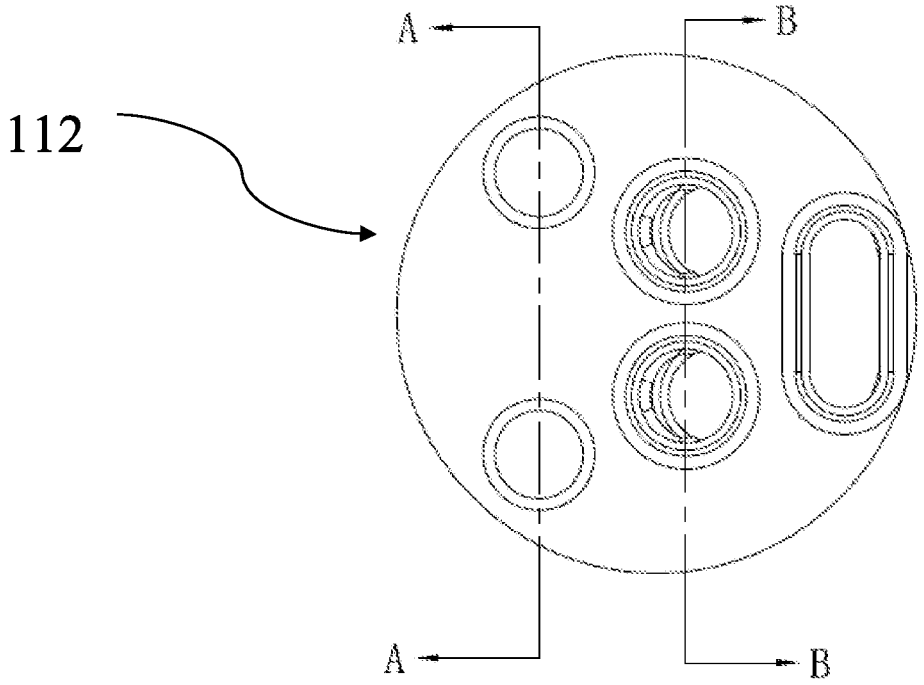
FIG. 19 is a front view of the mixing valve base.
Figure 20:
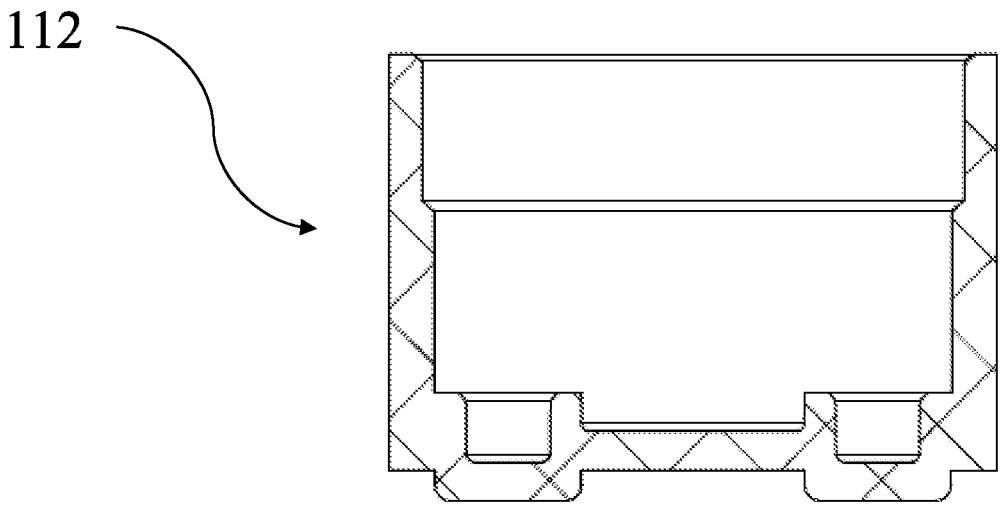
FIG. 20 is a sectional view of FIG. 19 along line A-A.
Figure 21:
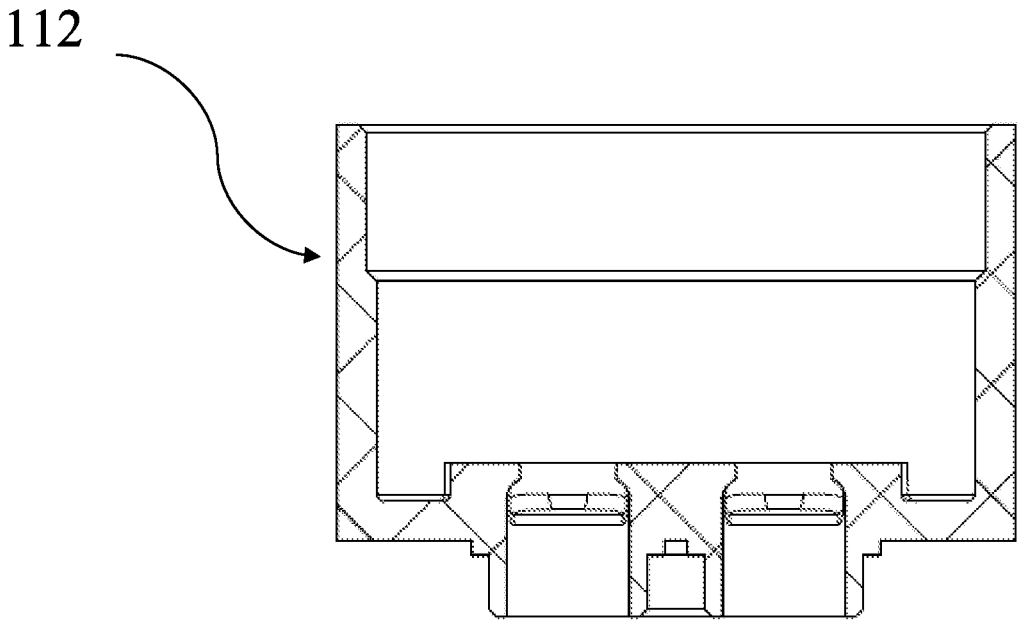
FIG. 21 is a sectional view of FIG. 19 along line B-B.
Figure 26:
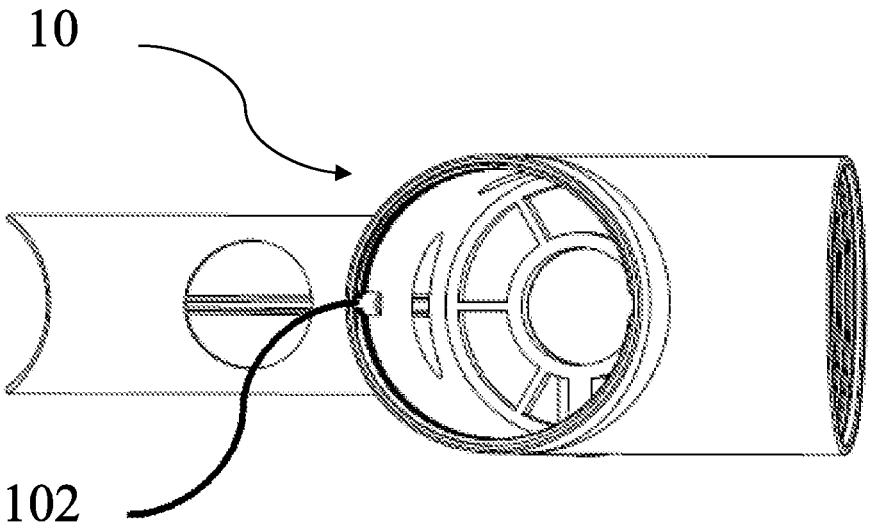
FIG. 26 is a bottom view of the housing.

In the FIG. 14, the fluid diverted base 12 is provided with an anti-rotation portion 125 (see FIG. 13) in the radial direction at its lateral portion adjacent to its lower end, in particular at lower engagement between the delimited wall 124 and the fluid diverted base 12. The anti-rotation portion can be bump, flange and so on. An anti-rotation engagement 102 (as shown in FIG. 26) is provided at the corresponding position of the inner wall of housing 10 and the anti-rotation engagement can be a locking groove, locking hole, etc. When the fluid diverted base 12 is mounted in the housing 10, the anti-rotation portion 125 is cooperated with the anti-rotation engagement 102, thereby limiting the movement of the fluid diverted base 12 relative to the housing 10. It is certain that other structures with anti-rotation functions is conceivable for the skilled person in the art based on the enlightenments provided by this invention, however, these other structures being routine means for the skilled person in the art does not go beyond the protection scope of this invention.

Referring to FIG. 2 and FIG. 27, the arm 104 is provided on the housing 10 in its radial direction. The arm 104 is also provided with additional outlet end. Under the situation of the fluid being directed through the mixing valve 11, the mixing water from the mixing valve 11 is delivered to the additional outlet end of the arm 104 through the switching valve 13 and finally the fluid flows towards the shower head though the outlet end, if the switching valve 13 has been operated. It is certain that the aforesaid working process can be adjusted and exchanged as desired and the definition of working configuration (work or not work) can also be exchanged, which do not go beyond the protection scope of this invention.

Figure 4:
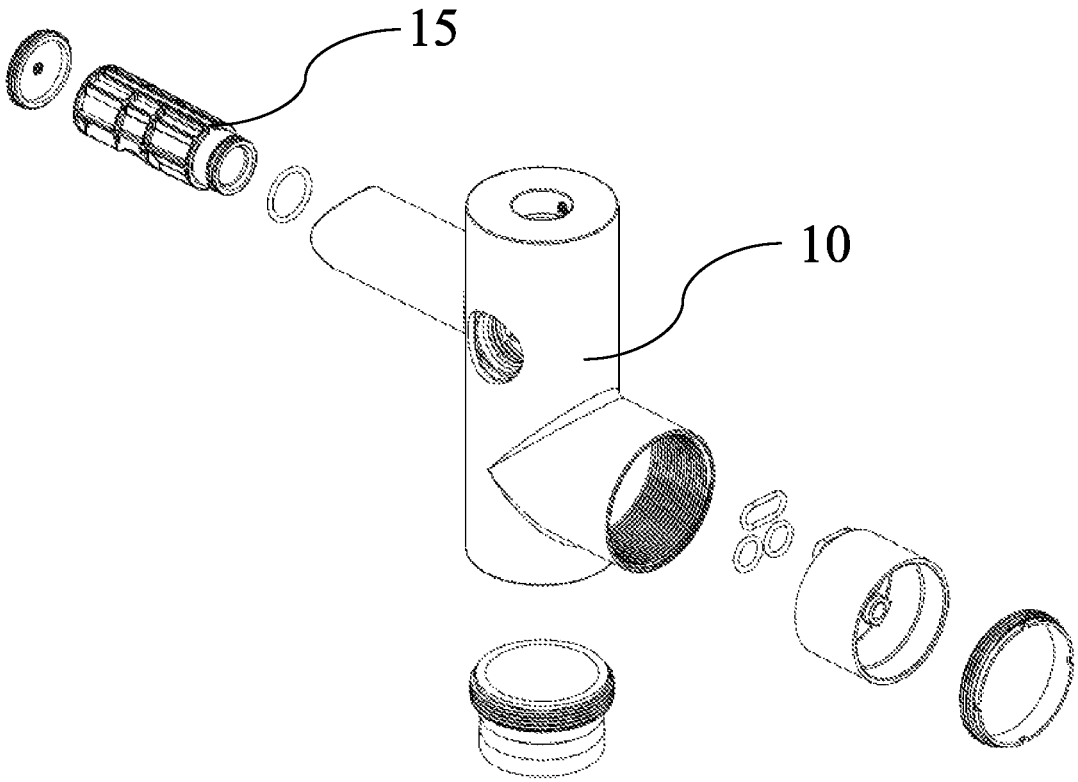
FIG. 4 is a partially assembled view of FIG. 3.
Figure 5:
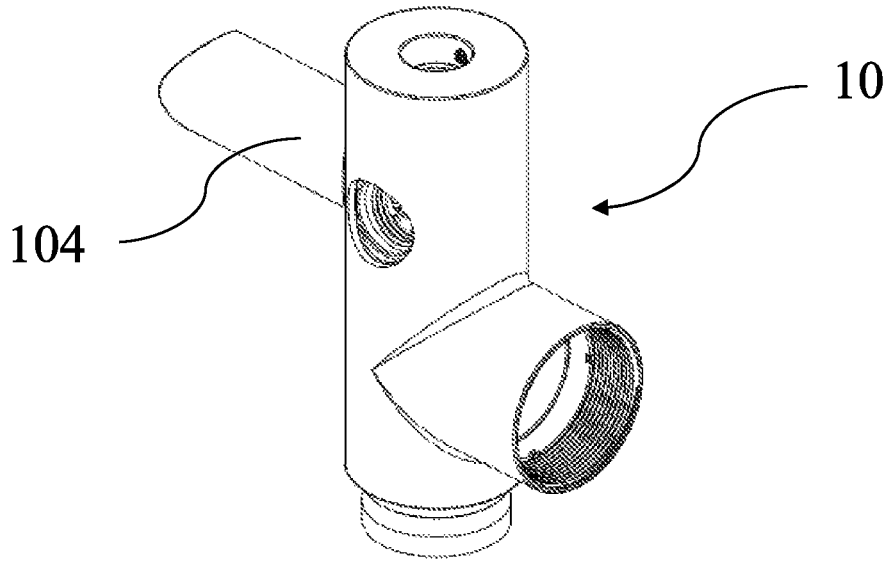
FIG. 5 is an entirely assembled view of FIG. 3.
Figure 6:
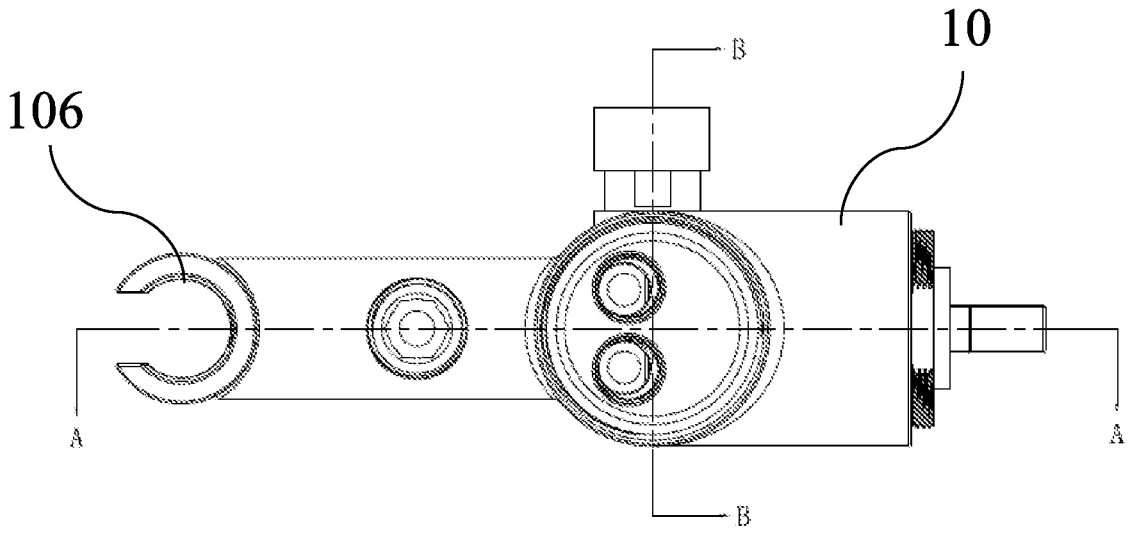
FIG. 6 is a bottom view of FIG. 5.
Figure 7:
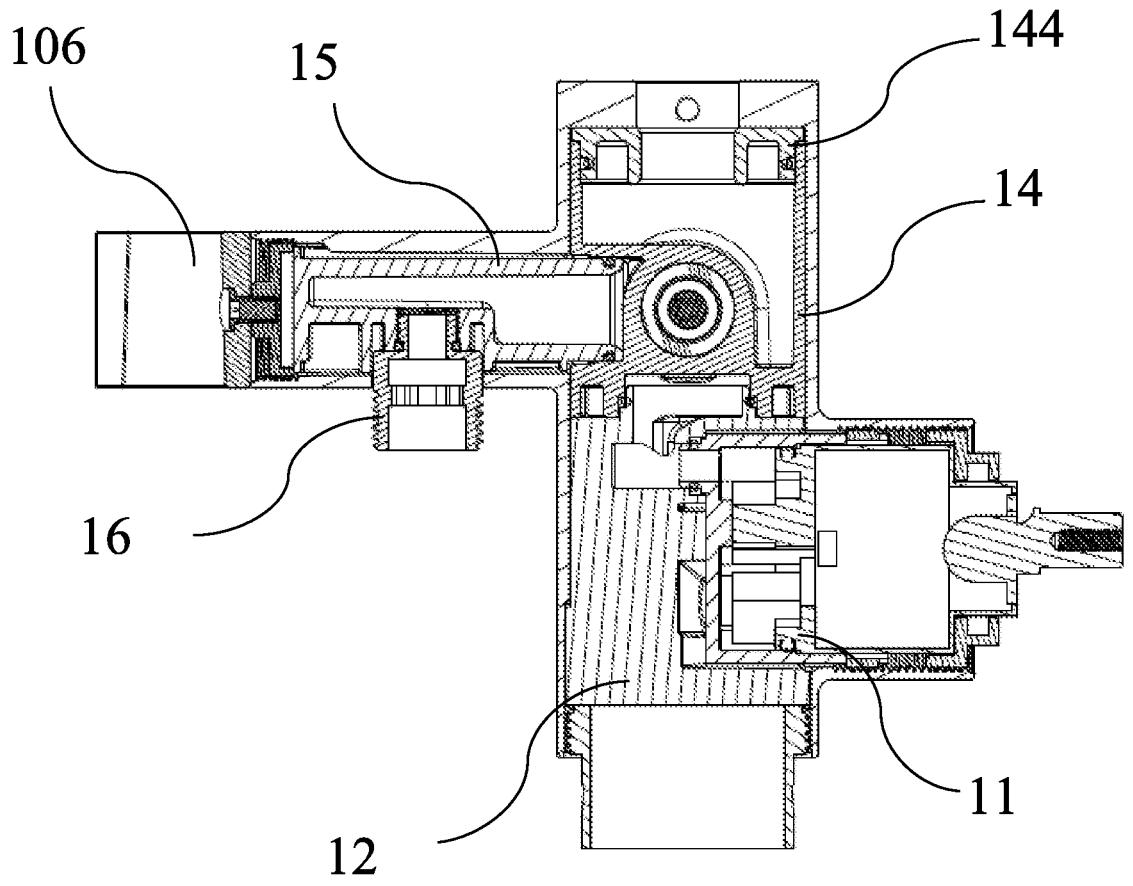
FIG. 7 is a sectional view of FIG. 6 along line A-A.
Figure 8:
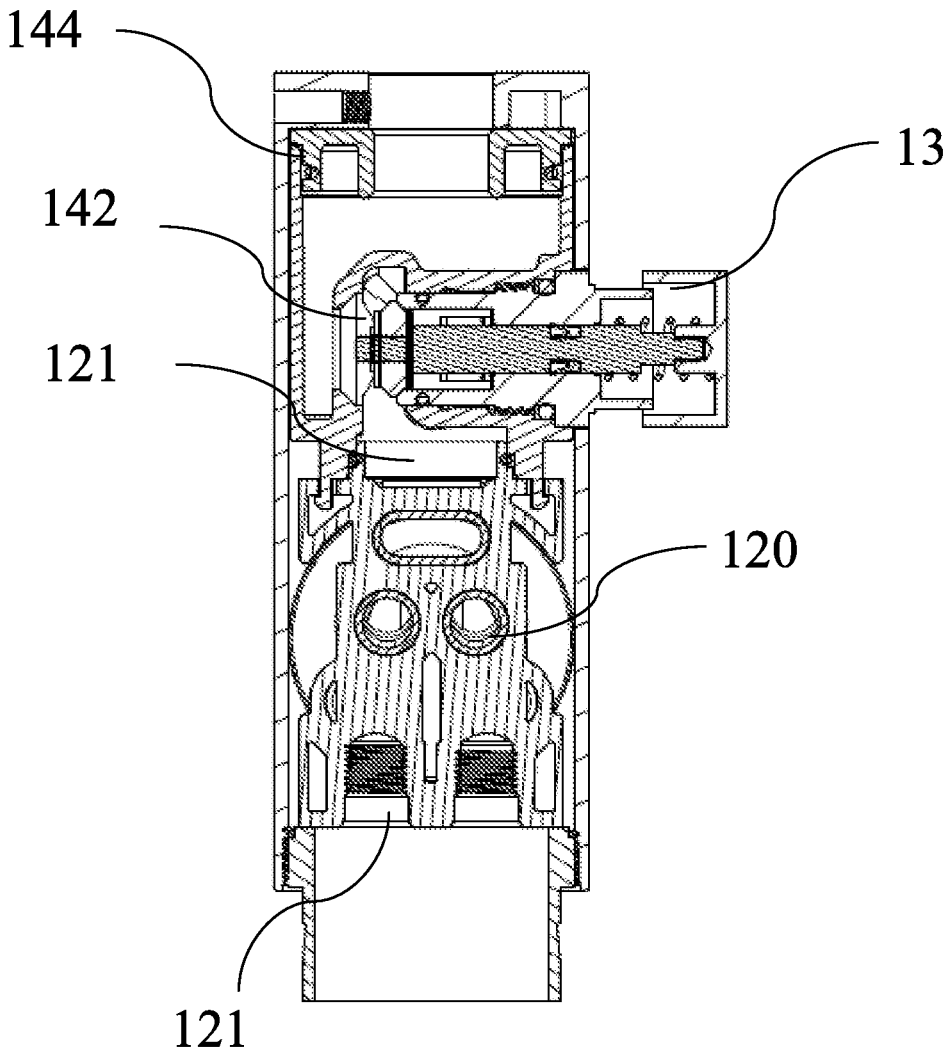
FIG. 8 is a sectional view of FIG. 6 along line B-B.
Figure 9:
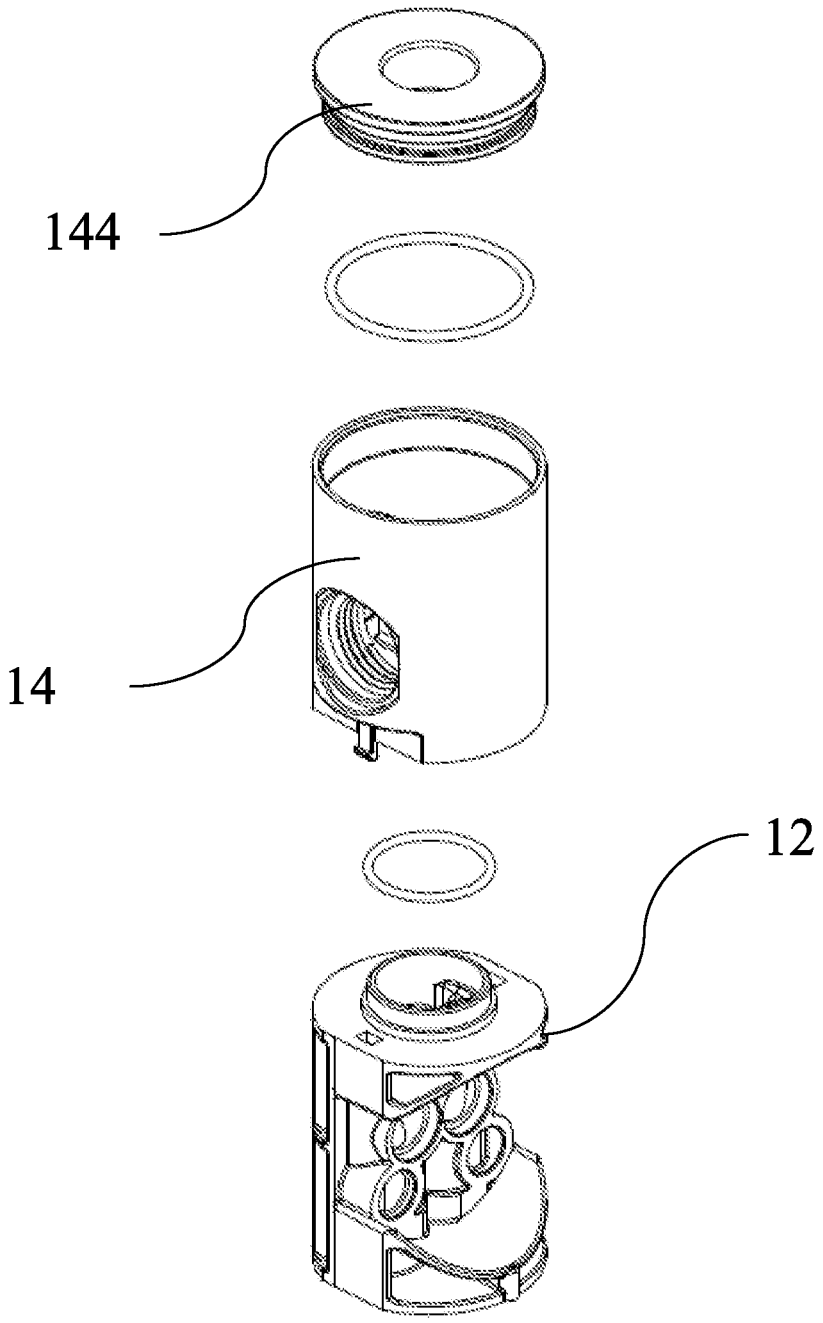
FIG. 9 is a partially enlarged and exploded view of the bathtub faucet as shown in FIG. 1.
Figure 11:
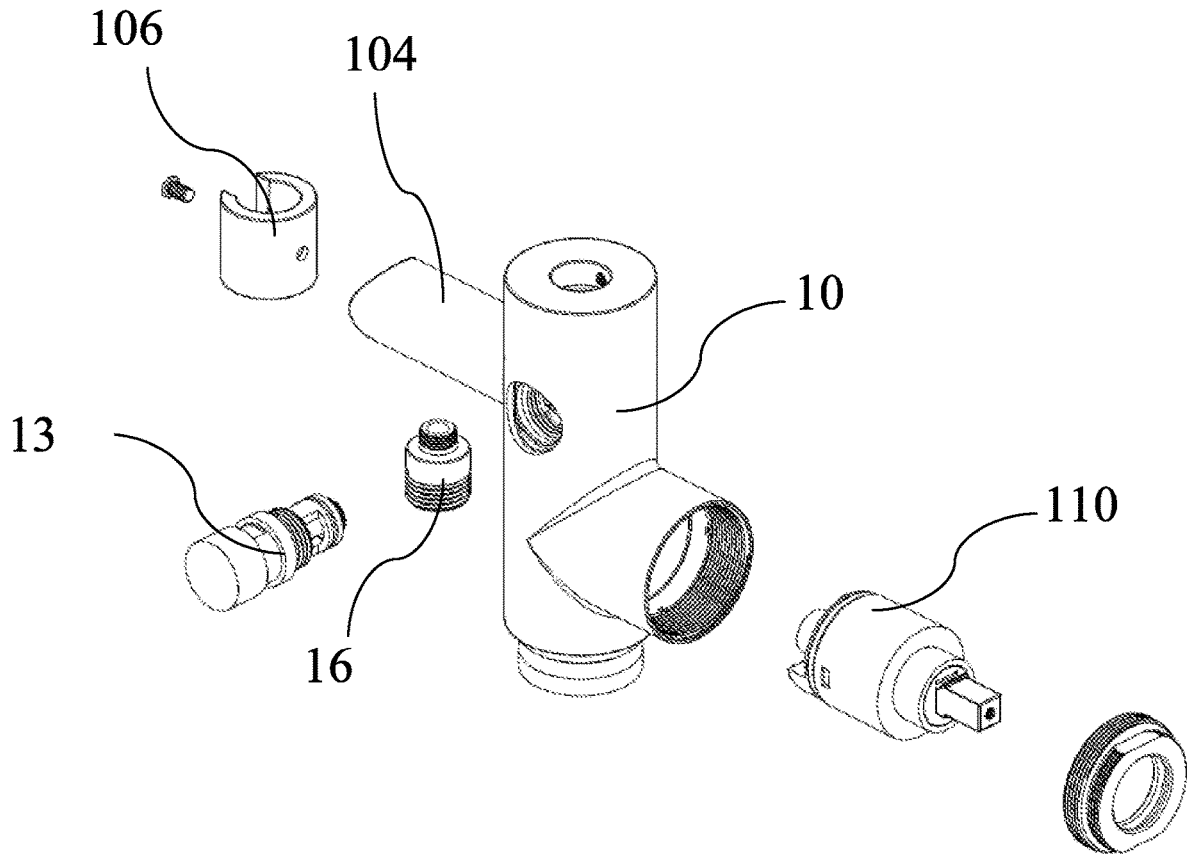
FIG. 11 is additional partially enlarged and exploded view of the bathtub faucet as shown in FIG. 1.

In the FIG. 1, FIG. 3 to FIG. 4, the inner cavity of the arm 104 also receives a shower adapter base 15 (which is also referred to as the third base 15). A connector 16 is radially provided on the arm 104. The connector 16 (which is also referred to as shower adapter connector 16) is connected to the outlet end of the arm 104 and communicated with the shower adapter base 15 in the arm 104. The fluid flowing along the axial direction of the arm 104 is directed to the outlet end of the arm 104 and then to the shower head connected with the connector 16 through the connector 16. As shown in FIG. 2, FIG. 6 and FIG. 11, a griping portion 106 is also provided on the end of the arm 104, i.e., one end of the arm 104 facing away from the housing 10. The griping portion 106 is configured into U shape with a lateral opening. A hosepipe of the shower head is connected to the connector at its introduction end, i.e., the shower head can be operated for spraying after the fluid being diverted to the shower adapter base 15 and subsequently supplied into the hosepipe. The shower head can be firmly positioned in the gripping portion, thereby facilitating the usage and placement.

The working configuration of the aforesaid bathtub faucet is described as follows.

The mixing valve 11 is opened mainly by the handle driving the mixing valve 11, and the cold/hot water pass through the fluid directing pipe into the inlet at the bottom of the fluid diverted base 12 and eventually into the fluid diverted base 12, and then the cold/hot fluid is diverted towards the mixing valve 11 and finally mixed by the mixing valve 11. The mixed water subsequently passes through the mixing water outlet and reaches the upper outlet of the fluid diverted base 12 by means of the diversion of the fluid diverted base 12. Under the working configuration of the switching valve 13, i.e., when the switching valve being pressed again which make the valve stem drive the core to the point of blocking the third fluid guiding port 142, the mixing water flows to the shower adapter base 15 and passes through the hosepipe connected to the connector after being diverted, and finally passes through the shower to the user.

If there is necessary for switching the usage configuration from the shower to the water nozzle, the switching valve 13 needs to be pressed again so that the valve stem of the switching valve 13 moves away from the third fluid guiding port 142 and the passage is opened between the water nozzle connected to the outlet end at the upper of housing 10 and the fluid diverted base 12, and thus the mixing water is delivered to the water nozzle.

It is possible that the switching valve 13 can be activated or deactivated in accordance with the user's operating custom or practical demands, and then the mixing valve 11 can be activated later. The aforesaid contents provided facilitates to the skilled person understanding the general flowing path and procedure of the fluid.

Although the invention is described through limited quantities embodiments, it is understood that the invention is not limited by such disclosed embodiments. Rather, any changes, modifications, replacements or equal devices which are not described previously are incorporated to revise the invention, however, which are equivalent to the spirit and scope of the invention. Furthermore, while various embodiments of the invention have been described, it is understood that the aspect of the invention can merely include some of the embodiments. Therefore, the invention is not regarded to be limited by the aforesaid description, however it is only limited by the appended claims.

LIST OF REFERENCE NUMERALS

1—bathtub faucet
10—housing
100—outlet end
102—anti-rotation engagement
104—arm
106—gripping portion
108—receiving portion
11—first valve, mixing valve
110—mixing valve spool
112—mixing valve base
1120—fixing elements
12—first base, fluid diverted base
120—first fluid guiding port
1200—cold/hot fluid guiding port
1202—mixture opening
121—second fluid guiding port
122—lateral recess portion

124—positioning portion/delimited wall
125—anti-rotation portion
126—fixing hole
127—locking hole
13—second valve/switching valve
14—second base/switching valve base
140—support portion
142—third fluid guiding port
144—cover
146—locking hooks
15—third base/shower adapter base
16—connector/shower adapter connector

The invention claimed is:

1. A bathtub faucet (1), comprising: a housing (10); a first valve (11), which is disposed in the housing in a radial direction of the housing (10) and configured for switching on or switching off the flow of the fluid towards its outlet ends (100) of the first valve; a first base (12), which is disposed in the housing in an axial direction of the housing (10) and configured for diverting the fluid therethrough, wherein the first base comprises: first fluid guiding ports (120), which are disposed along the radial direction of the first base (12); second fluid guiding ports (121), which are disposed at two ends of the first base (12) along its axial direction and are respectively communicated with the first fluid guiding port (120), wherein the first valve (11) is configured to sealingly engage to the first base (12) and communicated with the first fluid guiding ports (120), so that the fluid is controlled by the first valve (11) to be communicated with the second fluid guiding port (121) at an upper end or shut off, wherein the fluid is introduced from the second fluid guiding port (121) at the lower end and then diverted through the first fluid guiding port (120); wherein a support portion (140) is configured within a second base (14) for engaging a second valve (13), wherein the support portion (140) is formed by an inner wall extending radially inwardly from the second base (14), and wherein a third fluid guiding port (142) is formed at the end extending from the inner wall; the second valve (13) is received in the support portion (140) and has two switching configurations; in the first configuration, the second valve (13) is pressed to block the third fluid guiding port (142) so that the fluid coming from the second fluid guiding port (121) at an upper end of the first base (12) is switched off and guided to a third base (15); in the second configuration, the second valve (13) is pressed to open the third fluid guiding port (142) so that the fluid coming from the second fluid guiding port (121) at the upper end of the first base (12) is delivered to the outlet end (100) at an upper end of the housing (10); wherein the housing (10) further comprises an arm radially disposed thereon, and one of the outlet ends (100) is disposed on the upper end of the housing (10) in the axial direction, and another outlet end (100) is disposed on the arm (104); the bathtub faucet (1) further comprises a third base (15), which is disposed in the arm (104) and configured for diverting the fluid flowing therein; and a connector (16), which is engaged to the third base (15) by passing through the outlet end (100) on the arm (104) and communicated with the third base (15).

2. The bathtub faucet according to the claim 1, wherein the housing (10) comprises at least two outlet ends (100); the bathtub faucet further comprises: a second valve (13), which is configured for switching the flowing path so as to discharge the fluid introduced by the first valve (11) through one of the outlet ends (100); a second base (14), which is disposed in the housing along an axial direction of the housing (10) and engaged to the first base (12), and the second base (14) is communicated with the second fluid guiding port (121) at the upper end of the first base (12); wherein the second valve (13) is disposed along the radial direction of the second base (14) and partially engaged therein.

3. The bathtub faucet according to the claim 1, wherein the first base (12) is configured as a columnar member with a lateral recess portion (122), and the first valve (11) can be seated in the lateral recess portion (122) and sealingly engage to water inlets and a water outlet of the first fluid guiding port (120).

4. The bathtub faucet according to the claim 3, wherein the water outlet is configured into a ring shape and communicated with the second fluid guiding port (121) at the upper end of the first base (12).

5. The bathtub faucet according to the claim 3, wherein the lateral recess portion (122) further comprises a positioning portion (124) which is engaged to the first valve (11) so as to delimit the first valve in the lateral recess portion (122).

6. The bathtub faucet according to the claim 1, wherein an anti-rotation portion (125) is disposed on the first base (12) adjacent to its lower end in the radial direction, and an inner circumference surface of the housing (10) is provided with an anti-rotation engagement (102), wherein the anti-rotation portion (125) is matched with the anti-rotation engagement (102) so as to prevent undesired rotation of the first base (12) relative to the housing (10).

7. He bathtub faucet according to the claim 2, wherein the second base (14) is seated on the first base (12) and engaged to the first base (12).

8. The bathtub faucet according to the claim 1, wherein the arm (104) is provided with a gripping portion (106) at its end away from the housing (10), and the gripping portion (106) is configured for supporting a shower head, a fluid introduction end of which is connected to the connector (16).

* * * * *